US006966511B2

(12) United States Patent
Aihara et al.

(10) Patent No.: US 6,966,511 B2
(45) Date of Patent: Nov. 22, 2005

(54) CRUSHER ROTOR

(75) Inventors: Shuichi Aihara, Tokyo (JP); Takato Kaya, Tokyo (JP)

(73) Assignee: Metso Minerals (Matamata) Ltd., Matamata (NZ)

( * ) Notice: Subject to any disclaimer, the term of this patent is extended or adjusted under 35 U.S.C. 154(b) by 0 days.

(21) Appl. No.: 10/377,143

(22) Filed: Feb. 11, 2003

(65) Prior Publication Data

US 2004/0011904 A1 Jan. 22, 2004

Related U.S. Application Data

(63) Continuation of application No. PCT/JP01/06822, filed on Aug. 8, 2001.

(30) Foreign Application Priority Data

Aug. 11, 2000 (JP) ..... 2000-245045

(51) Int. Cl.[7] ..... B02C 13/09

(52) U.S. Cl. ..... 241/189.1; 241/275

(58) Field of Search ..... 241/275, 189.1

(56) References Cited

U.S. PATENT DOCUMENTS 3,474,974 A 10/1969 Wood ..... 241/275
6,179,234 B1 * 1/2001 Marshall et al. ..... 241/275

FOREIGN PATENT DOCUMENTS

JP 50-7771 1/1975
JP 2000-153169 6/2000

* cited by examiner

*Primary Examiner*—Mark Rosenbaum
(74) *Attorney, Agent, or Firm*—Jacobson Holman PLLC

(57) ABSTRACT

The invention provides a crusher rotor for which the influence of centrifugal force is minimal, the hammer is compact, and the load on the attachment bolts can be reduced. A notch 16*b* is provided in an attachment plate 16 so as to take a force of a hammer tip 22, directed in a radial outward direction of a rotor 1, and a protrusion 22*b* for engaging with the notch 16*b* is provided on the hammer tip 22.

4 Claims, 8 Drawing Sheets

CRUSHER ROTOR

This is a Continuation of PCT/JP01/06822 filed Aug. 8, 2001 and published in Japanese.

FIELD OF THE INVENTION

The present invention relates to a crusher rotor for crushing minerals or other such raw materials.

SUMMARY OF THE PRIOR ART

Rotary Mineral Crushers are apparatus having a cylindrical rotor which rotates at high speed about a vertical axis, such that raw material which is introduced to the rotor is discharged from ejection ports on the outer face of the rotor due to the centrifugal force generated by rotation of the rotor, and collides with a surrounding dead-bed and is thus finely broken up.

As a method for increasing crusher productivity in this type of apparatus, there has been proposed a method as shown in FIG. 7 and FIG. 8, where hammers 52 are protrudingly provided on the outer face of a rotor 50, so that raw material to be crushed 58 is broken up by the hammers 52.

That is, the hammers 52 comprise a hammer base 53, and a hardened tip 57 which is welded to a protruding portion of this hammer base 53, and the hammer base 53 is secured to an attachment plate 55 by attachment bolts 56.

The aforementioned rotor 50 has the following problems.

1. Two external forces, namely the impact force when hammer 52 strikes the raw material 58, and the centrifugal force generated by the rotor 50 rotating at high speed, act on the hammer 52 and on the attachment bolts 56.

Therefore, the hammer 52 must be sufficiently rigid to counteract these two external forces. Hence the hammer 52 must be made large, requiring space and giving an increase in weight.

2. In order to attach the large size hammer 52, a large diameter and high strength attachment bolt 56 is necessary, and the cost for attaching the hammer 52 is increased, so that these points need to be improved.

OBJECT OF THE INVENTION

It is therefore an object of the present invention to provide a crusher rotor which can be compactly designed, and for which the attachment cost for the hammer can be reduced.

Another object of the present invention is to overcome, at least in part the disadvantages of the prior art, or at least to provide the public with a useful choice.

SUMMARY OF THE INVENTION

In a first aspect the present invention consists, in a crusher rotor which rotates about a vertical axis and has ejection ports opened on an outer face thereof, an attachment plate is provided on the outer face of the rotor, a hammer is provided secured to the attachment plate and protruding radially outward from the outer face of the rotor, a receiving face is formed on the attachment plate for taking a centrifugal force generated in the hammer, and an engagement face is formed on the hammer for engaging with the receiving face.

Preferably, the crusher rotor comprises a hammer base secured to the attachment plate, and a hammer tip removably attached to the hammer base, and an engaging face is formed on the hammer tip for engaging with the receiving face of the attachment plate.

In a further aspect the present invention consists in a crusher rotor as herein after described with reference to FIGS. 1 through 6.

DETAILED DESCRIPTION OF THE PRESENT INVENTION

Figure 1:
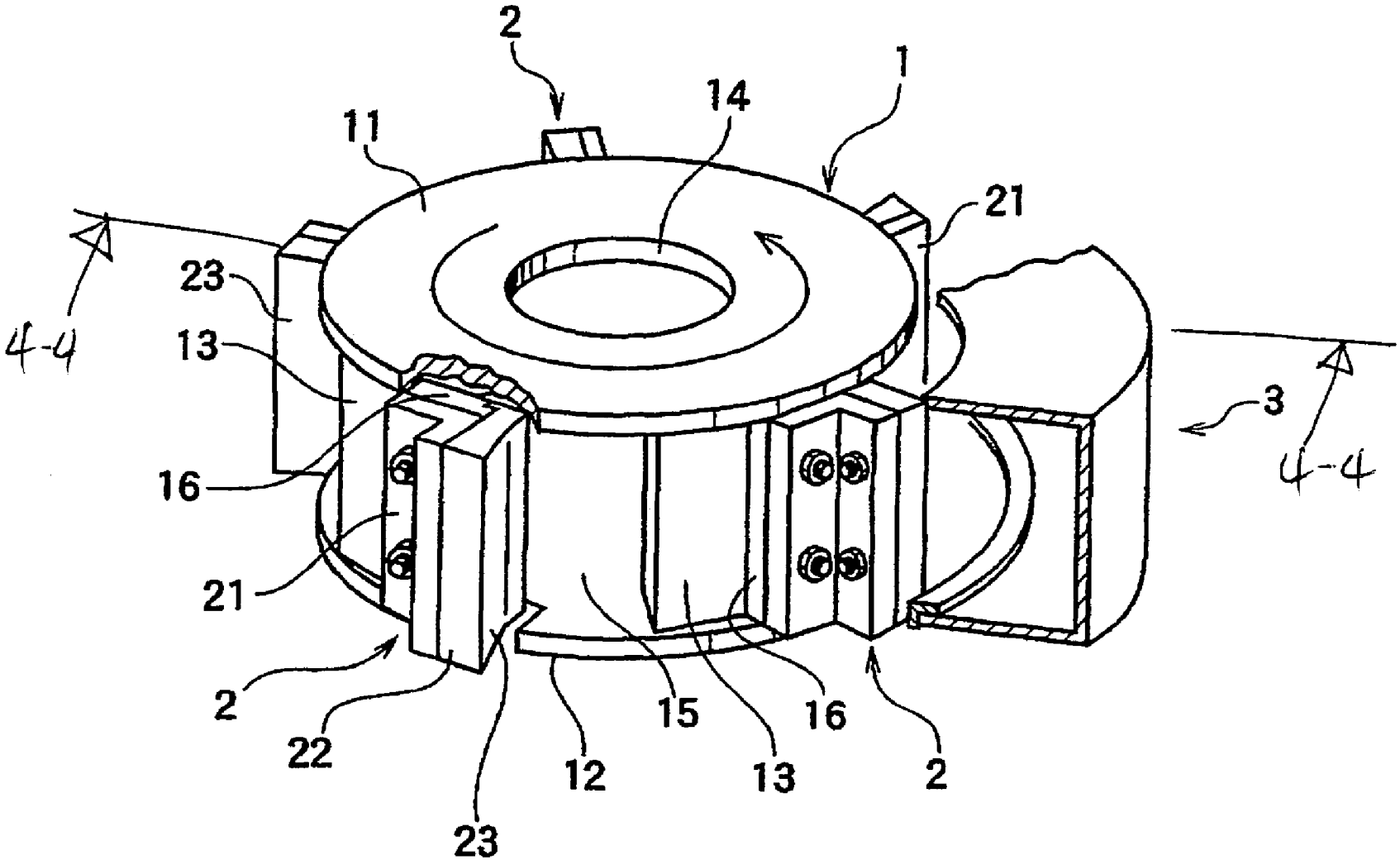
FIG. 1 is a cut away perspective view of part of a crusher according to a first embodiment of the present invention.
Figure 2:
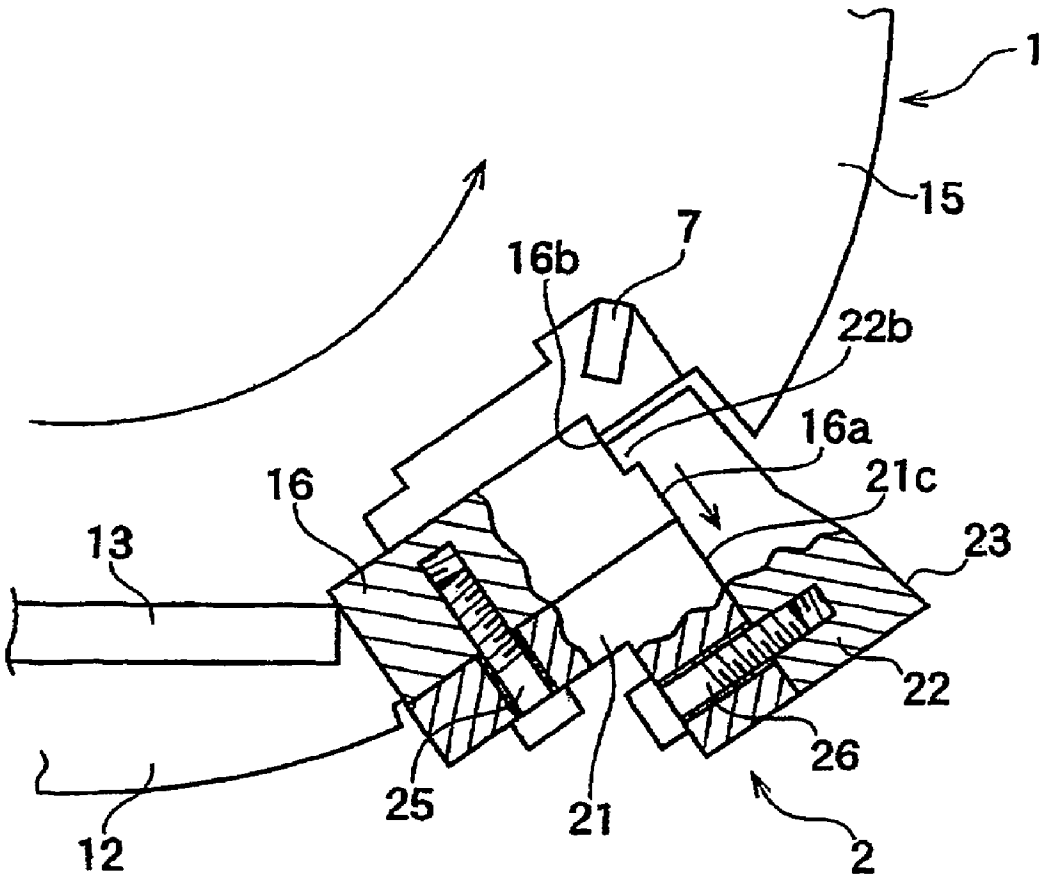
FIG. 2 is a plan view drawing of the hammer and attached plate on the rotor.

Preferred embodiments according to the present invention are explained below, with reference to FIGS. 1 through 6.

First Embodiment of the Invention

1. Structure of the Crusher

The crusher houses a substantially drum-shaped rotor 1, with a pulverising chamber 3 formed surrounding the rotor 1. Within the pulverising chamber 3 is formed a dead-bed 4, being an accumulation of the raw material 5 that is ejected from the rotor 1. The build up of this bed is achieved as ejected materials collect in the pulverising chamber. The bed creates mineral on mineral impact for crushing and prolongs the wear of components of the rotary mineral crusher.

2. The Rotor

The rotor 1 is formed by axially aligned parallel opposing disk-like upper and lower plates 11 and 12 respectively, and at least one side-plate 13 which joins these at their circumference. A plurality of ejection ports 15 are formed in the outer face and the rotor rotates about its vertical axis (see FIG. 1). These ports are normally equally spaced about the axis of rotation to keep the rotor in balance, however they may not necessarily be as counter-weight may be provided to maintain balance.

A feeder port 14 is formed in the centre of the upper plate 11, so that the material to be crushed can be fed continuously from above into the interior of the rotor 1.

Attachment plates 16 are attached to the outer face of the rotor 1.

3. Attachment Plate

Each attachment plate 16 presents an approximately rectangular parallelepiped shape and is formed with a notch 16*b* in an end face 16*a* near the ejection port 15.

Figure 3:
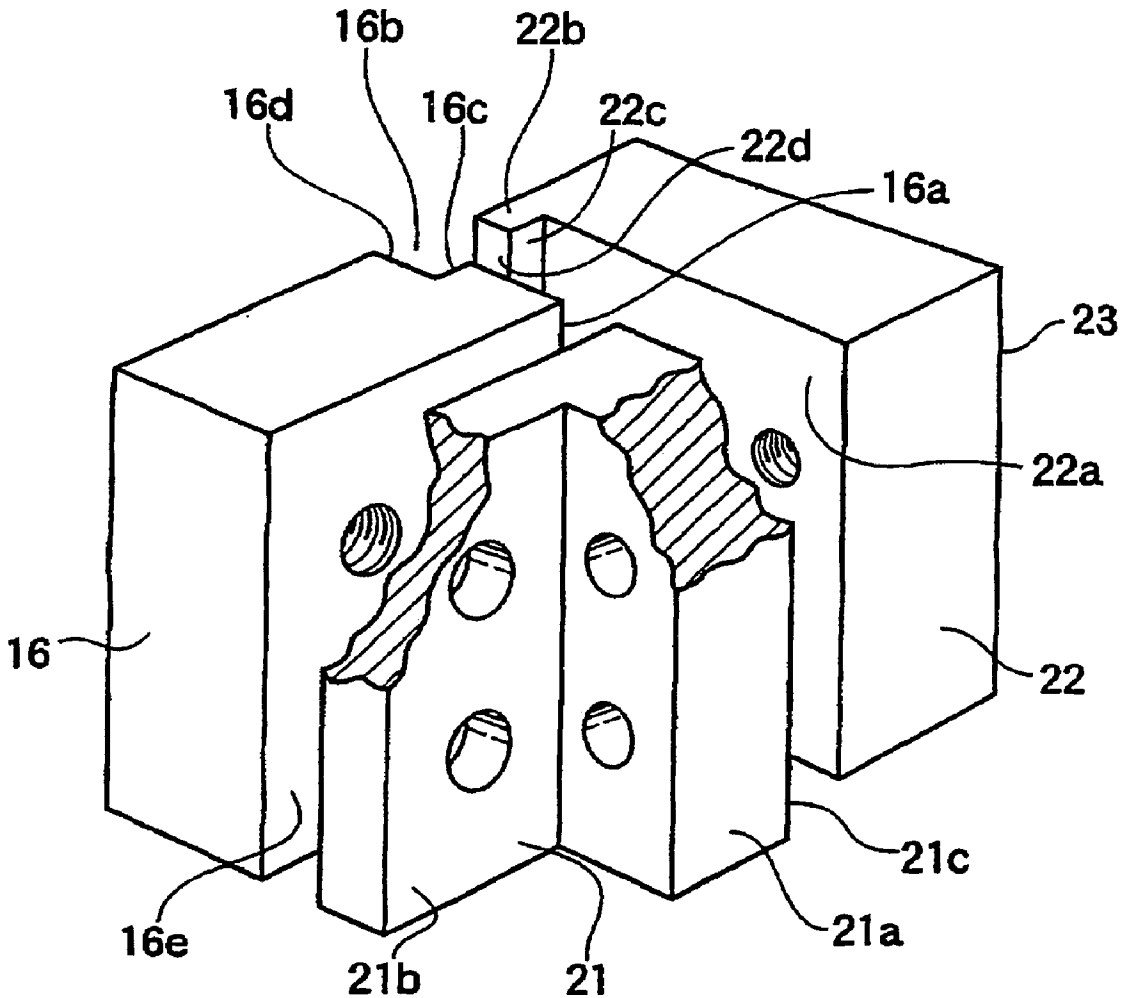
FIG. 3 is a perspective view cross-sectional elevation along line 4—4 of FIG. 1 of the hammer and its attachment.

The notch 16*b* as shown in FIG. 3, is formed with a receiving face 16*c* along the peripheral direction of the rotor 1 and a step face 16*d* along the radial direction of the rotor 1.

An attachment face 16*e*for attaching a later mentioned hammer base 21, is formed on an outside (outer side of the rotor 1) of the attachment plate 16.

Furthermore, a bit 7 is attached to the inside (inner side of the rotor 1) of the attachment plate 16.

4. Hammer body

The hammer 2 comprises a hammer base 21 formed for example in an approximate L-shape, and a hammer tip 22 removably attached to the hammer base 21.

5. Hammer Base

The approximate L-shape hammer base 21 is formed with a protrusion 21*a* with a side face 21*c* for face contact with the hammer tip 22, and a base 21*b* for attachment to the attachment plate 16.

The hammer base 21 is not limited to an L-shape, and may be formed for example as a rectangular body, with the hammer tip 22 attached to an end face.

6. Hammer Tip

On an attachment face 22*a* of the hammer tip 22 is formed a protrusion 22*b* which can engage in the complimentary notch 16*b* of the attachment plate 16 on the rotor 1 side.

The protrusion 22*b* as shown in FIG. 3, is formed with an engaging face 22*c* along the peripheral direction of the rotor 1, and a step face 22*d* along the radial direction of the rotor 1.

An engaging means is constituted by the complimentary notch 16*b* of the attachment plate 16 and the protrusion 22*b* of the hammer tip 22.

That is, by face contacting the engaging face 22*c* of the hammer tip 22 and the receiving face 16*c* of the attachment plate 16, the centrifugal force generated in the hammer 2 can be transmitted to the attachment plate 16 and supported thereby.

The attachment face 22*a* of the hammer tip 22 is in close face contact with the end face 16*a* of the attachment plate 16 and the side face 21*c* of the hammer base 21, so that the end face 16*a* of the attachment plate 16 and the side face 21*c* of the hammer base 21 are in approximately the same plane.

As a result, the hammer tip 22 can be attached to the hammer base 21, in close face contacted with the attachment plate 16 and the hammer base 21.

A hammer face 23 of the hammer tip 22 is formed from a metal plate of a hard material, connected integrally by welding, moulding or other known attachment techniques.

(5) Attachment of the Hammer

As mentioned before, the base 21*b* of the hammer base 21 is attached to the attachment plate 16 by one or more tightening bolts 25, after which the hammer tip 22 is secured to the protrusion 21*a* of the hammer base 21 by one or more bolts 26.

When the hammer tip 22 is attached to the hammer base 21, it is important that the engaging face 22*c* of the hammer tip 22 is abutted closely against the receiving face 16*c* of the complimentary notch 16*b*.

In this way, a hammer base 21 and a hammer tip 22 are attached to each of the attachment plates 16 to thereby assembly the plurality of hammers 2 radially on the outer face of the rotor 1.

In this example, the case is shown for where the hammers 2 are protrudingly provided in the vicinity of the respective ejection ports 15 of the rotor 1. However, the attachment position for the hammers 2 is not limited to this, and need only be on the outer face of the rotor 1.

Operation of the Invention

Figure 4:
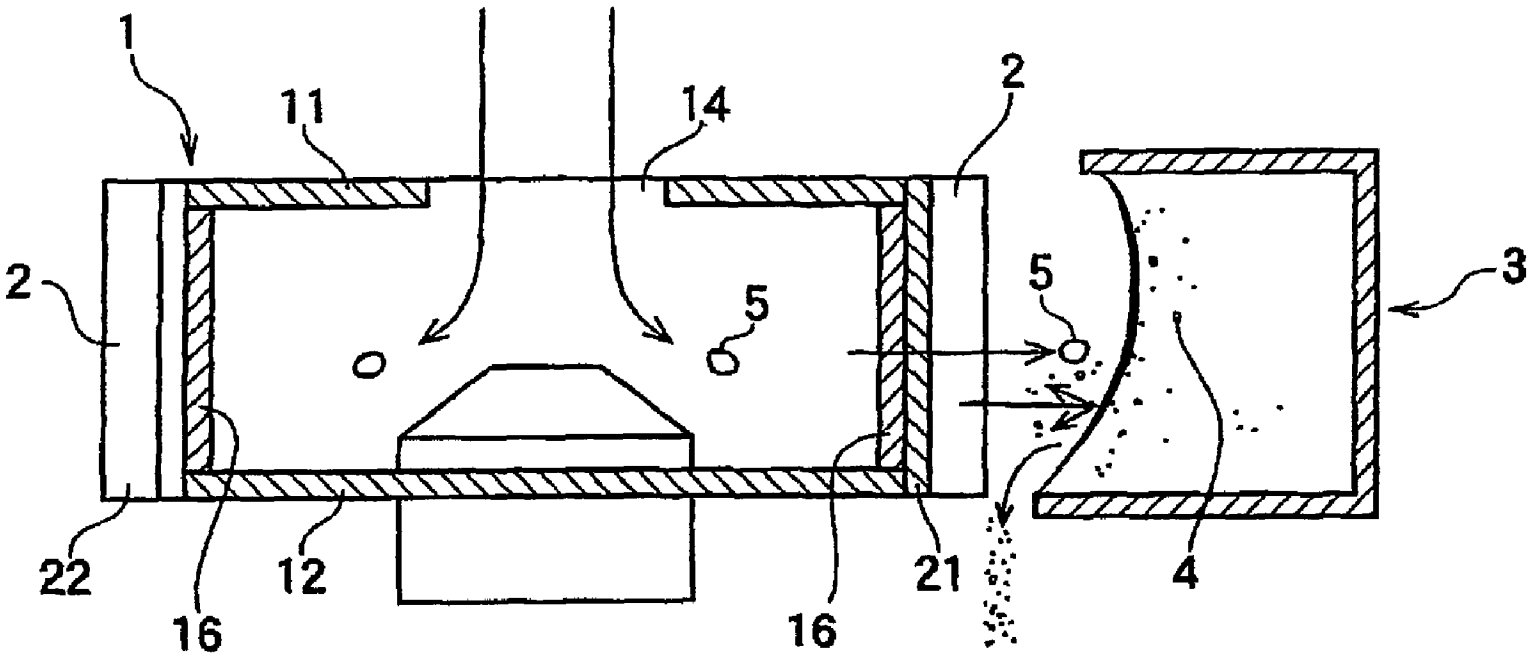
FIG. 4 is a front elevation view showing the operation of the crusher and the mineral flow path.

Next is a description of the pulverizing operation of the crusher, with reference to FIG. 1 and FIG. 4.

1. Theory of Pulverisation

The mineral or other material to be pulverised 5 which is continuously introduced into the interior of the rotor 1 via the feeder port 14, is ejected from the ejection ports 15 by the centrifugal force generated by the rotation of the rotor 1, and collides with the surrounding dead-bed 4 and is pulverised.

Moreover, a part of the material 5 which rebounds from the dead-bed 4, strikes the hammers 2 (hammer tips 22) and is pulverised.

Finely pulverized material 5 falls down through the gap between the rotor 1 and the pulverising chamber 3.

The impact force when the material 5 is crushed is transmitted from the hammer tip 22 to the hammer base 21 and the attachment plate 16.

In the present invention, the end face 16*a* of the attachment plate 16 and the side face 21*c* of the hammer base 21 are formed in the same plane, and the entire surface is abutted against the attachment face 22*a* of the hammer tip 22. Therefore the impact force is distributed over the hammer base 21 and the attachment plate 16, and absorbed.

Due to the high speed of the rotor 1, a centrifugal force acts on the hammer 2.

In the present invention, the receiving face 16*c* formed in the notch 16*b* of the attachment plate 16 which constitutes the engaging means, and the engaging face 22*c* formed on the protrusion 22*b* of the hammer tip 22 are engaged, so that the centrifugal force acting on the hammer 2 can be reliably received.

Since in this way, the impact force is distributed and absorbed over the hammer base 21 and the attachment plate 16, and the centrifugal force is received by the engaging means, it is not necessary to increase the rigidity of the hammer 2 and make this a large size, as heretofore.

Furthermore, since the impact force acting on the hammer 2 is absorbed by the attachment plate 16, the shear force acting on the bolts 25 which attach the hammer base 21 is minimal, and normal attachment bolts may be used.

Moreover, since the centrifugal force acting on the hammer 2 is transmitted to the attachment plate 16 via the engaging means, a shear force does not act on the bolts 26 which attach the hammer tip 22.

Consequently, normal attachment bolts may be used for the bolts 26.

In this manner, only tensile forces act on the attachment bolts 25 and 26 and there is practically no shear force.

The hammer face 23 which strikes the material 5 is subjected to wear.

In the case of wear, this can be dealt with by removing the bolts 26 and replacing only the hammer tip 22.

Therefore, instead of replacing the entire hammer 2, the replacement operation is simplified, and only the hammer tips 22 need be prepared as the replacement components, which is extremely economical.

Second Embodiment of the Invention

Next is a description of another embodiment according to the present invention.

In the first embodiment, the notch 16*b* was provided on the attachment plate 16, and the protrusion 22*b* was provided on the hammer tip 22 to thereby receive the centrifugal force generated in the hammer 2. However the protrusion may be provided on the attachment plate 16 and the notch may be provided on the hammer tip 22 to receive the centrifugal force.

Figure 5:
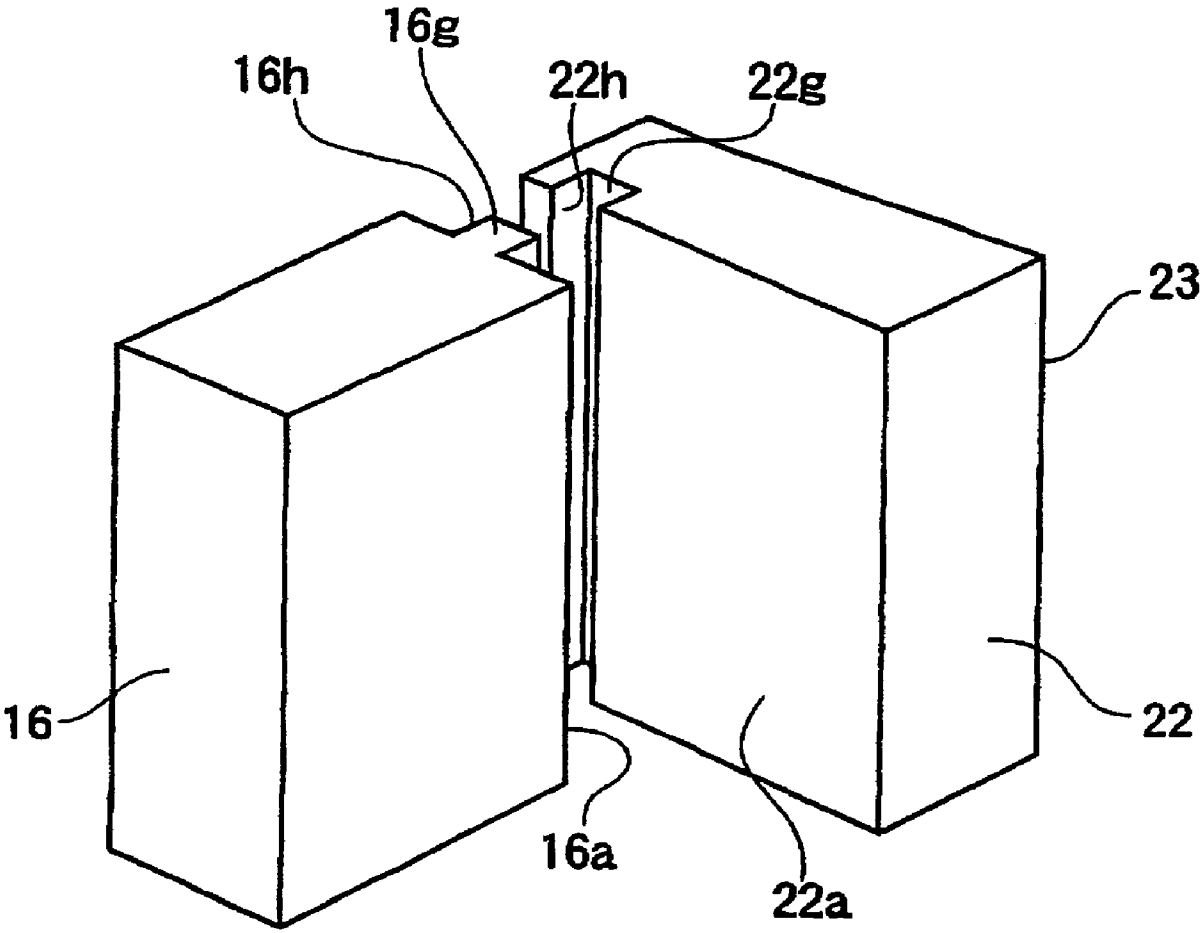
FIG. 5 is a perspective view of a second hammer embodiment.

That is, as shown in FIG. 5, an angular protrusion 16*g* is provided at the approximate centre of the end face 16*a* of the attachment plate 16.

The angular protrusion 16*g* is formed with a receiving face 16*h* along the peripheral direction of the rotor 1, and a protruding face along the radial direction of the rotor 1 approximately orthogonal to each other.

In the attachment face 22*a* of the hammer tip 22 on the diametric inside of the rotor 1 is provided an angular notch 22*g* so as to be engagable with the angular protrusion 16*g*.

The angular notch 22*g* also, as with to the angular protrusion 16*g*, is formed with an engaging face 22*h* along the peripheral direction of the rotor 1 and a recess face along the radial direction of the rotor 1 approximately orthogonal to each other.

The hammer tip 22 is attached to the hammer base 21 with the engaging face 22*h* of the angular notch 22*g* closely abutted against the receiving face 16*h* of the angular protrusion 16*g*.

As a result, the centrifugal force generated in the hammer tip 22 can be received by the engaging face 22*h* and the receiving face 16*h*.

Third Embodiment of the Invention

Figure 6:
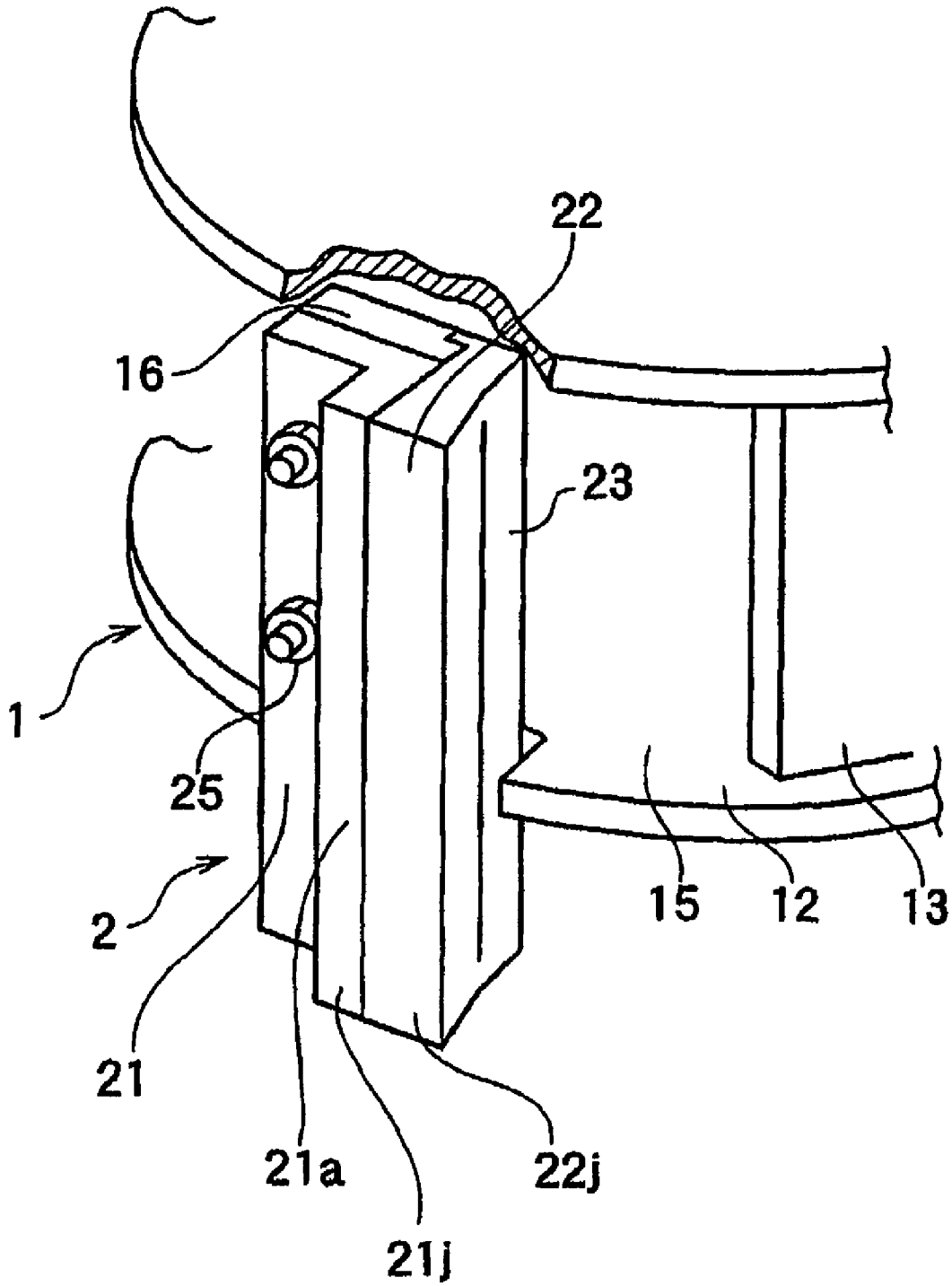
FIG. 6 is a perspective view of a further embodiment hammer tip and hammer base.
Figure 7:
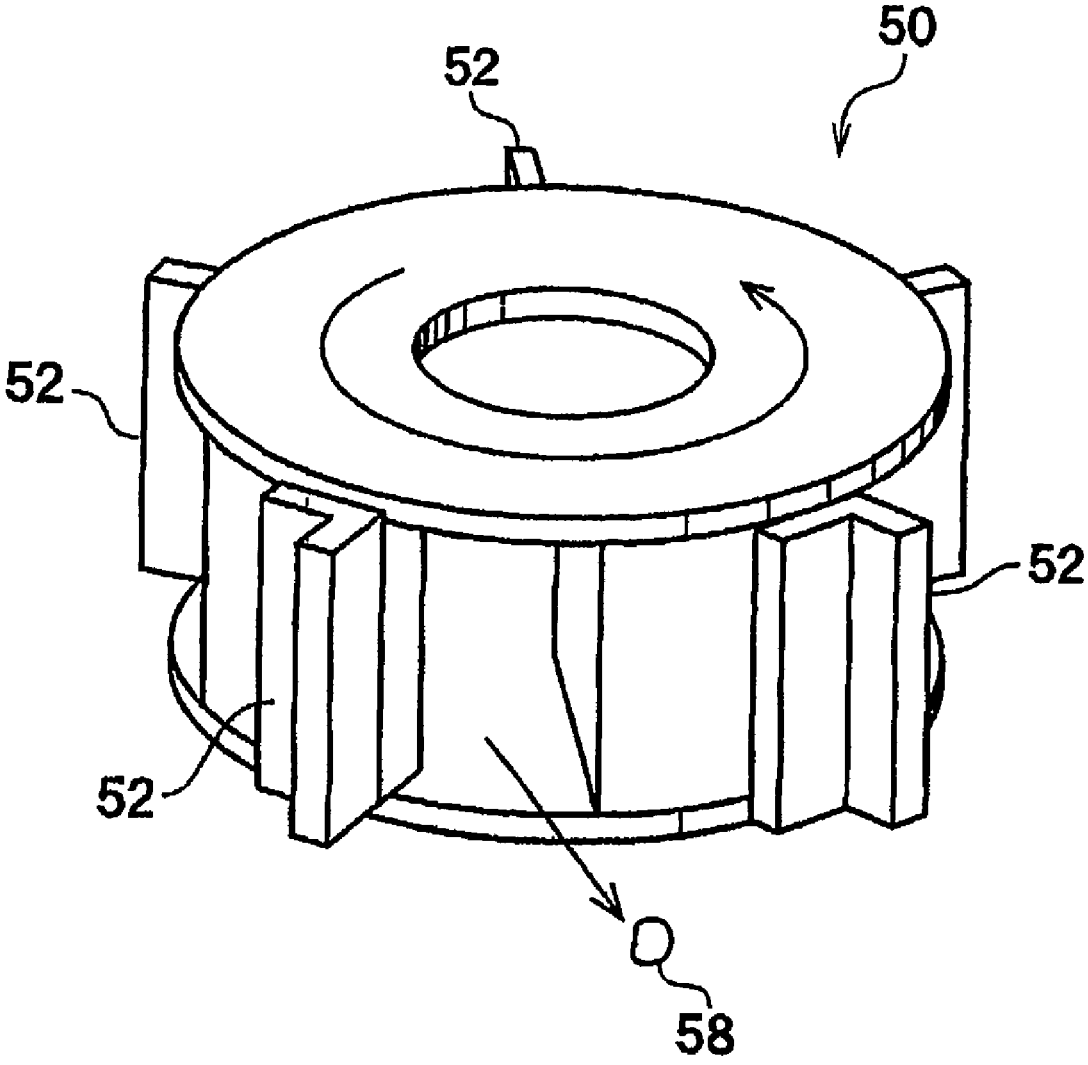
FIGURE 7 (PRIOR ART)
FIG. 7 is a perspective view of a conventional rotor.
Figure 8:
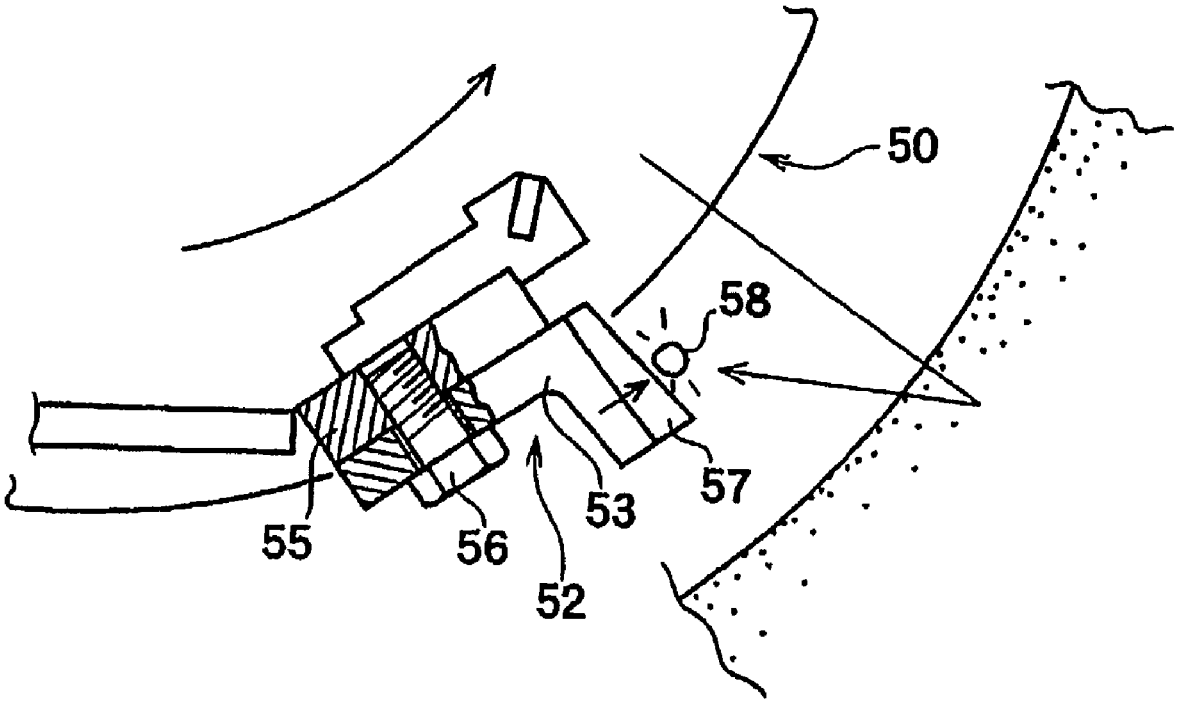
FIGURE 8 (PRIOR ART)
FIG. 8 is a perspective view of a conventional hammer attached to a rotor.

As shown in FIG. 6, the invention is also applicable to a rotor of a type where the hammer 2 extends downward from the lower plate 12 of the rotor 1.

The hammer base 21 and the hammer tip 22 are respectively formed with extensions 21*j* and 22*j* extending downward from the lower plate 12 of the rotor 1.

The L-shape hammer base 21 having the extension 21*j* is attached by bolts 25 to the attachment plate 16.

The hammer tip 22 is attached to the protrusion 21*a* of the hammer base 21 by bolts (not shown) in the same way as for the first embodiment.

As with the first embodiment, the hammer base 21 need not be formed in an L-shape, and may be formed as a rectangular body or the like, and the hammer tip 22 may be attached to an end face by tightening bolts 26.

As a result, the respective extensions 21*j* and 22*j* of the hammer base 21 and the hammer tip 22 protrude downwards from the lower plate 12.

There are some particles of the raw material 5 which rebound downwards from the dead-bed 4. However, if the extensions 21*j* and 22*j* are formed in this manner protruding downward from the lower plate 12, the falling raw material 5 again strikes the extensions 21*j* and 22*j* and can be reliably broken up.

INDUSTRIAL APPLICABILITY

The present invention, due to the above described form, achieves the following effects.

1. The impact force is distributed over the hammer base 21 and the attachment plate 16, and absorbed, and the centrifugal force is received by the engaging means. Therefore there is no need to increase the rigidity of the hammer 2 or make this a larger size as heretofore, enabling a compact design.
2. Since it is not necessary to make the hammer large, a rotor can be provided at low cost, requiring minimum space and attachment costs for the rotor can be reduced.
3. In the case where the hammer wears, this can be dealt with by replacing the hammer tip, so that only the hammer tips need be prepared, which is extremely economical.

What is claimed is:

1. A crusher rotor which rotates about a vertical axis and has ejection ports opened on an outer face thereof, said crusher rotor comprising an attachment plate provided on the outer face of said rotor, a hammer secured to said attachment plate and protruding radially outward from the outer face of the rotor, a receiving face formed on said attachment plate for taking a centrifugal force generated in said hammer, and an engagement face formed on said hammer engaging with said receiving face, said hammer including a hammer base secured to said attachment plate and a hammer tip removably attached to said hammer base, an engaging face on said hammer tip engaging with said receiving face of said attachment plate.

2. The crusher rotor according to claim 1, wherein said hammer base is secured to said attachment plate by a penetrative fastener.

3. The crusher rotor according to claim 2, wherein said hammer tip is secured to said hammer base by a penetrative fastener.

4. The crusher rotor according to claim 1, wherein said hammer tip includes a protrusion engaging a notch of the attachment plate.

* * * * *